United States Patent [19]

Higgins et al.

[11] 4,126,209

[45] Nov. 21, 1978

[54] MAST MOUNTING

[75] Inventors: Robert D. Higgins, Highland Heights; Richard A. Schwehr, Mentor, both of Ohio

[73] Assignee: Towmotor Corporation, Mentor, Ohio

[21] Appl. No.: 823,904

[22] Filed: Aug. 12, 1977

[51] Int. Cl.[2] ..... B66F 9/20

[52] U.S. Cl. ..... 187/1 R; 187/9 R; 214/674; 280/80 R

[58] Field of Search ..... 187/1 R, 9 R; 214/670, 214/671, 672, 673, 674; 280/80 R

[56] References Cited

U.S. PATENT DOCUMENTS 3,782,571 1/1974 Murphy et al. ..... 214/674

3,915,324 10/1975 Green et al. ..... 214/674

*Primary Examiner*—Robert W. Saifer
*Assistant Examiner*—Jeffrey V. Nase
*Attorney, Agent, or Firm*—Phillips, Moore, Weissenberger, Lempio & Majestic

[57] ABSTRACT

A lift truck having a frame which includes parallel beams having forward ends that terminate in bifurcated ends forming upper and lower portions with U-shaped openings therebetween adapted to receive a front drive axle assembly therein for forward removal from the frame. Co-planar transverse plates are secured to the upper and lower portions of the beam ends and have hanger plates including upward opening hook removably attached thereto for supporting a mast assembly thereon.

13 Claims, 6 Drawing Figures

MAST MOUNTING

BACKGROUND OF THE INVENTION

This invention relates to the field of fork lift trucks and more particularly to means for mounting a lift mast assembly on the lift truck frame. One prior art arrangement provides a lift truck frame which includes a front transverse member having J-hooks provided thereon which form upward opening slots for reciving the center portions of mast mounting pins rotatably mounted in brackets on the back of a mast assembly. Such an arrangement is shown in U.S. Pat. No. 3,915,324.

While such arrangements provide a means for securely mounting a lift mast assembly on a lift truck frame in a manner that facilitates removal thereof from the frame, the extensive frame structure required at the front of the lift truck frame to support the loads applied thereto have inhibited removal of the front axle assembly for repair.

SUMMARY OF THE INVENTION

Accordingly, it is an object of the present invention to provide a frame construction for a lift truck which affords ready removal of the front axle assembly from the lift truck frame.

Another object is to provide such a frame construction which also employs the feature and advantages of a J-hook and pivot pin mast mounting assembly.

These and other objects and advantages are achieved by the present invention which provides a lift truck frame that includes parallel longitudinal beam members having bifurcated forward ends that include upper and lower portions having U-shaped openings therebetween adapted to receive an axle assembly therein. Transverse plates are welded to the upper and lower portions and have threaded bores provided therein. Hanger plates having J-hooks provided thereon are adapted to extend between the upper and lower portions of the beam ends across the U-shaped openings therebetween to enclose an axle assembly disposed therein, and are removably secured thereto by bolts threadably secured in said bores.

DESCRIPTION OF THE PREFERRED EMBODIMENT

Figure 1:
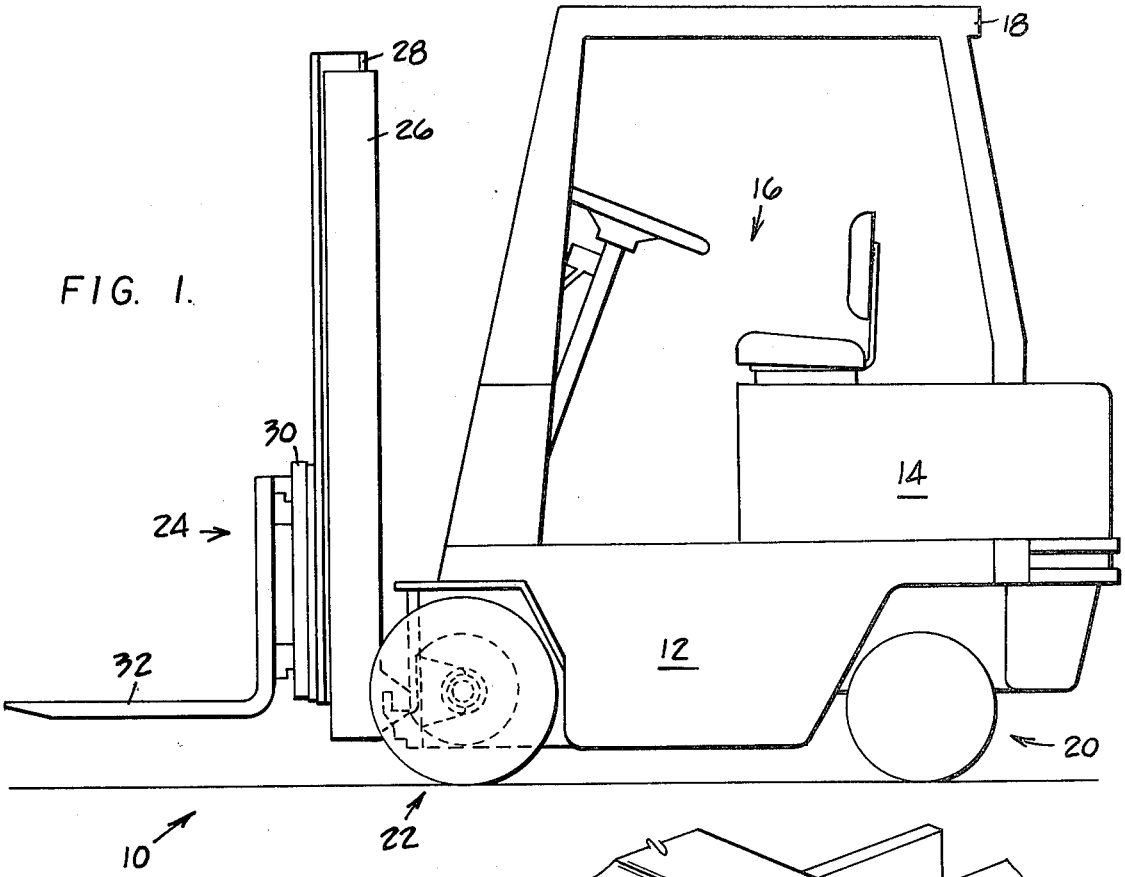
FIG. 1 is a side elevational view of a lift truck embodying the present invention.

Referring to FIG. 1, a lift truck embodying the present invention is shown generally at 10 and includes a frame 12, an engine or battery compartment 14 mounted on the frame, an operator's station indicated generally at 16 protected by an overhead guard 18. A rear axle assembly 20 is mounted on the frame in the conventional manner. A front drive axle 22 is mounted on the frame in a manner to be described.

Also mounted on the frame in a manner to be described is a lift mast assembly 24 which includes pairs of vertically movable uprights 28 and stationary uprights 26 having a carriage 30 mounted thereon which in turn has forks 32 carried thereon in the conventional manner.

Figure 2:
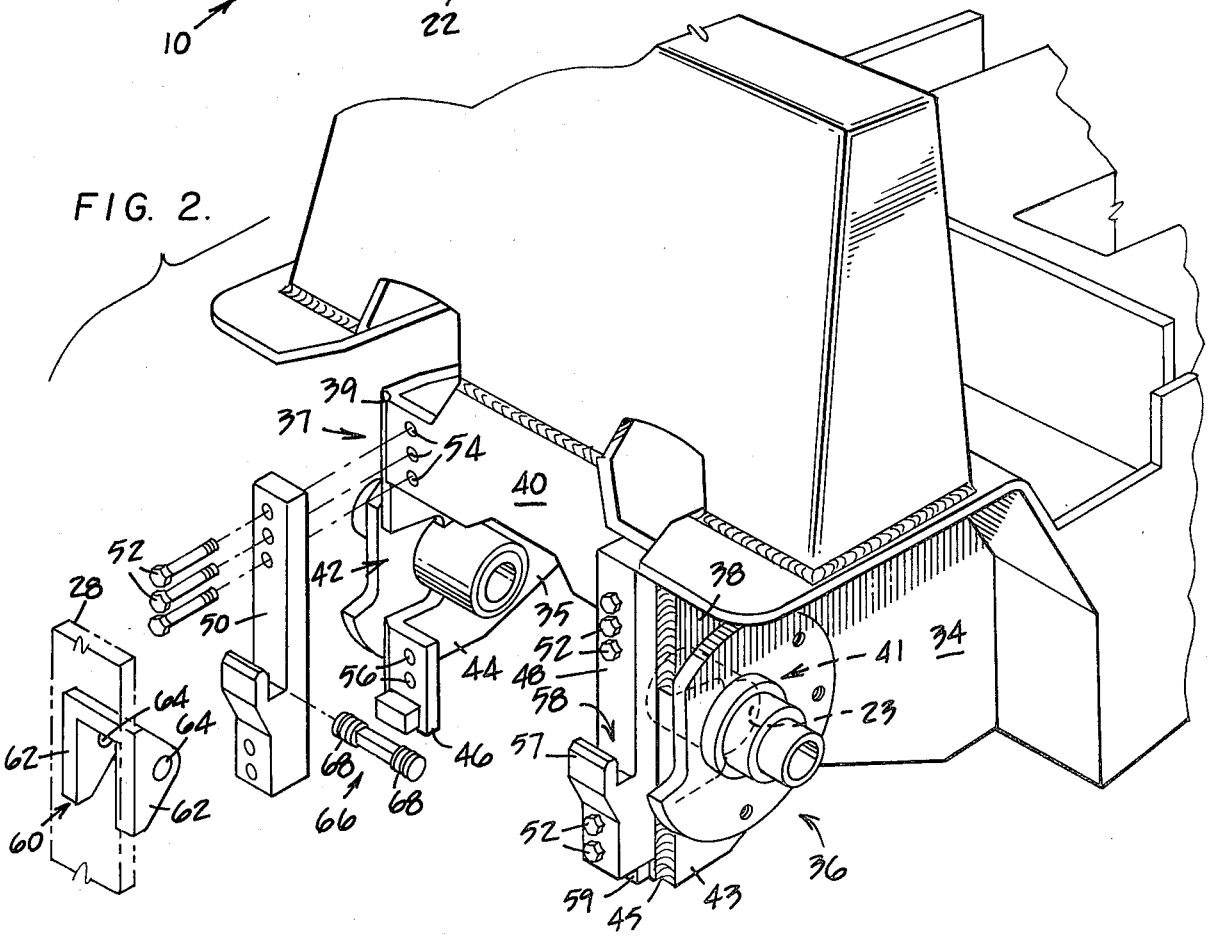
FIG. 2 is an exploded view of a portion of the lift truck frame of FIG. 1.
Figure 4:
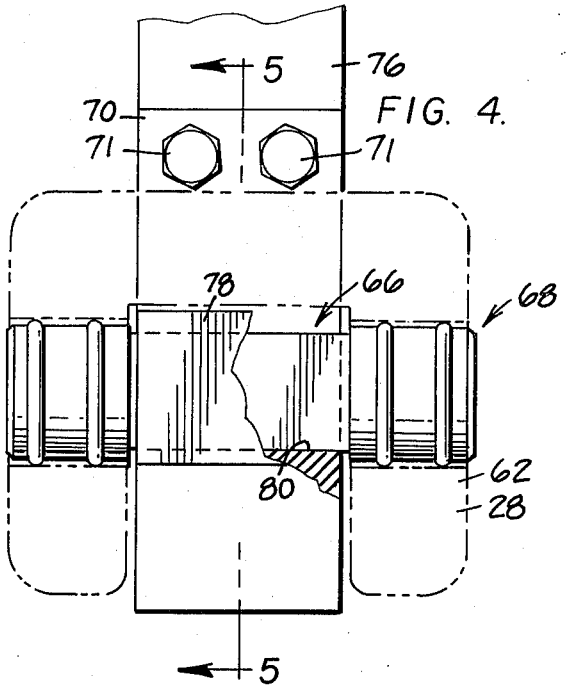
FIG. 4 is a front view of the J-hook and pin employed in the embodiment shown in FIG. 3.
Figure 5:
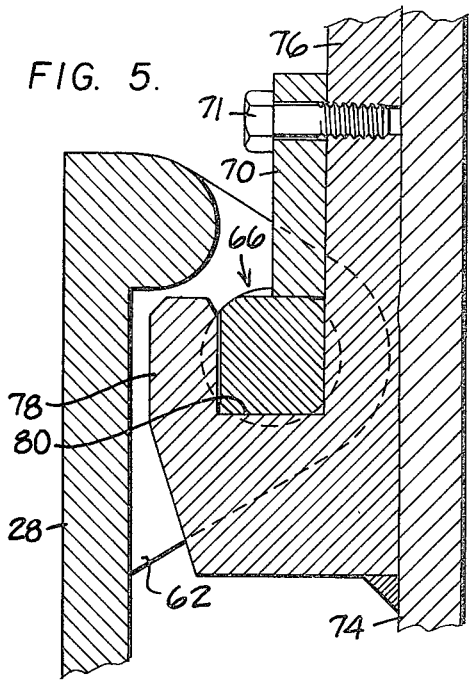
FIG. 5 is a sectional view of the hook and pin shown in FIG. 4 taken along the line indicated by the arrows 5—5.
Figure 6:
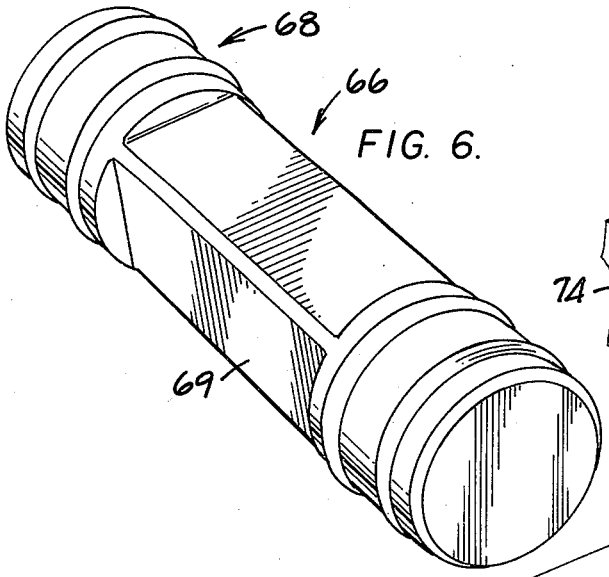
FIG. 6 is a perspective view of the pin employed in the present invention.

Referring to FIG. 2, frame 12 includes parallel vertical beam members 34 and 35 which project forwardly of the intermediate portion of the lift truck and terminate in yoke-shaped ends 36 and 37, which include upper portions 38 and 39 which are joined by a transverse vertical gusset plate 40 at their upper forward ends.

Below gusset plate 40 the yoke-shaped ends of the boom members include means forming generally U-shaped openings 41 and 42 adopted for reception of the front axle 22 therein. Portion 23 of the U-shaped openings may be designed to closely embrace portions of wheel spindles of a drive axle disposed therein. Lower portions 43 and 44 of ends 36 and 37 have tab plates 45 and 46 welded thereto co-planar with gusset plate 40.

Vertical hanger plates 48 and 50 are secured to the front of gusset plate 40 and tab plates 45 and 46 by means of bolts 52 threadably secured in bores 54 and 56. The hanger plates have J-hooks 57 provided thereon forming upwardly opening rectangular slots 58 for mounting of the mast assembly on the frame.

Shear blocks 59 are welded to tabs 45 and 46 immediately below hanger plates 48 and 50 for vertical support thereof to prevent shear stress in bolts 52.

Secured to the rear of masts are mast brackets 60 provided by spaced parallel tabs 62 having axial aligned bores 64 provided therein. Pivot pins 66 having cylindrical end portions 68 disposed in bores 64 and intermediate square-shaped center portions 69 which extend between tabs 62 and are received within rectangular slots 58. A retainer block 70, shown in FIG. 3, is secured above slot 58 by means of bolts 71, and engages the square portion of the pivot pin to retain it in the slot.

Figure 3:
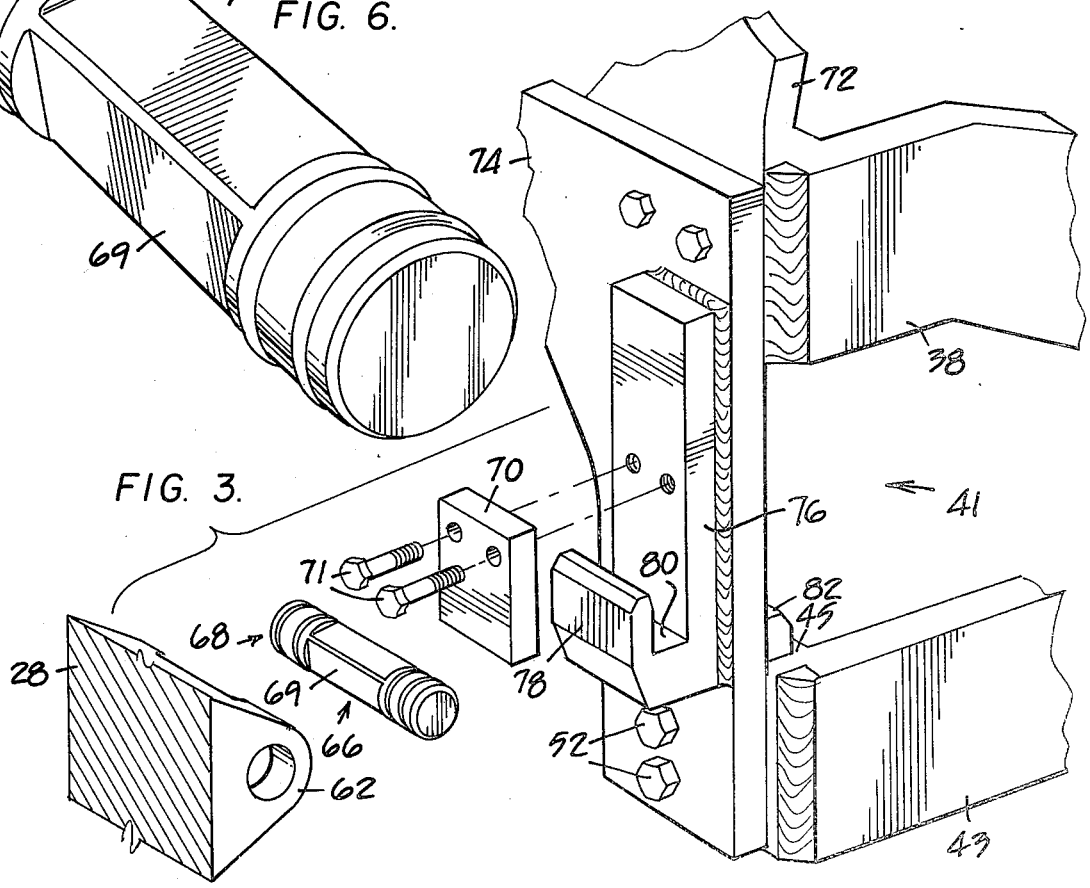
FIG. 3 is an exploded view of an alternative embodiment of the present invention.

An alternative embodiment is shown in FIG. 3 wherein the upper portion 38 of the beam ends has a tab plate 72 secured thereto similar to tab plate 45. A combined gusset and hanger plate 74 extends between and is secured to tabs 72 and also extends downward to tabs 45 and 46 (not shown). A J-hook member 76 is welded to each side of plate 74, and includes a hook portion 78 which forms an upward opening slot 80, for reception of the mast support pins 66 therein.

A shear block 82 is welded to the back of plate 74 immediately above tab plates 45 and 46 (not shown) to relieve bolts 52 of shear forces resulting from loading of plate 74.

A retainer block 70 is removably securable to J-hook 76 above slots 58 by means of bolts 71 to retain the mast support pins 66 in the slots.

The foregoing constructions allow for easy removal of the front drive axle 22 for repair after removal of the hanger plates from the upper and lower portions of the front ends of the frame beam members, by moving it forward of the yoke-shaped ends of the beams.

As seen in FIG. 2, the profile of the U-shaped openings at the juncture of the upper and lower portions of the beams may be designed to closely embrace wheel spindles on an axle assembly disposed therein.

The embodiments of the invention in which an exclusive property or privilege is claimed are defined as follows:

1. Apparatus for mounting a mast assembly having pairs of spaced tabs having axially aligned bores provided therein, and support pins having their ends disposed in said bores and including intermediate portions adapted to be received in an upward opening slot means on a vehicle frame comprising:

a vehicle frame including spaced parallel beam members having means forming U-shaped forward ends which include upper and lower portions;

plate means removably secured to said upper and lower portions;

J-hook means provided on said plate means forming said upward opening slot means and adapted to receive said support pins; and an axle assembly disposed within said U-shaped openings in the ends of the frame beams which axle assembly may be removed therefrom by removal of the plate means from the beam members.

2. The invention of claim 1 further comprising a gusset plate joining the upper portions of the U-shaped beam ends, and tab plates secured to the lower portions of the U-shaped beam ends, and wherein the plate means are removably secured to the gusset plate and tab plates.

3. The invention of claim 1 further comprising tab plates secured to the upper and lower portions of the ends of the respective frame beams, and wherein the plate means comprises a mounting plate removably secured to the tab plates and extending between the upper tab plates, and the upper and lower tab plates, respectively, and the J-hook means are secured to said mounting plate.

4. The invention of claim 1 wherein said U-shaped forward ends further comprise juncture portions between said upper and lower portions which are arranged to embrace wheel spindles on said axle assembly disposed between said upper and lower portions.

5. A frame for a lift truck having J-hook members, a mast assembly and means for supporting the mast assembly on the J-hook members, comprising, parallel beam members having bifurcated ends including upper and lower portions defining U-shaped openings therebetween, a first plate member extending between the upper portions of the beam members, tab plates secured to the lower portions of the beam members, bolt means and threaded bore means in said first plate member and said tab plates, wherein the J-hook members are removably secured to the first plate member and the tab plates by said bolt means, and a drive axle assembly disposed in said U-shaped openings in the beam ends which drive axle assembly may be removed therefrom upon removal of the J-hook members from the first plate member and the tab plate members.

6. The invention defined in claim 5 further comprising shear blocks secured to the tab plates immediately below the J-hook members whereby shear forces in the bolt means are avoided.

7. A fork lift truck comprising spaced parallel frame members defining U-shaped openings at one end of said frame members, transverse plate members secured to said one end of said frame members, hanger plate means removably secured to said transverse plate members and spanning said U-shaped openings, means provided on said hanger plate means for receiving mast support shafts therein and an axles assembly disposed within said U-shaped openings in the frame members which may be removed therefrom upon removal of the hanger plate means from the transverse plate members.

8. The invention of claim 7 wherein said frame members comprise vertically planar beam members having bifurcated ends forming upper and lower portions.

9. The invention of claim 8 wherein said transverse plate members comprise tab plates secured to the lower portions of the beam members.

10. The invention of claim 9 further comprising a gusset plate secured to the upper portions of the beam members and extending therebetween.

11. The invention of claim 10 wherein the hanger plate means comprises hanger plates extending from said gusset plate to respective tab plates.

12. The invention of claim 9 further comprising tab plates secured to the upper portion of the beam members.

13. The invention of claim 12 wherein said hanger plate means comprises a plate extending from each of the tab plates on the lower beam portions to the tab plates on the upper beam portions respectively, and between the tab plates on the upper beam portions.

* * * * *